US006150985A

United States Patent [19]

Pritchard

[11] Patent Number: 6,150,985

[45] Date of Patent: Nov. 21, 2000

[54] ANTENNA FOR A CELLULAR PHONE

[75] Inventor: Gerald Pritchard, Waterford, Mich.

[73] Assignee: R. A. Van De Velde and Associates, Clinton Twp., Mich.

[21] Appl. No.: 08/449,682

[22] Filed: May 24, 1995

[51] Int. Cl.[7] ..... H01Q 1/32

[52] U.S. Cl. ..... 343/713

[58] Field of Search ..... 343/713, 704; H01Q 1/32

[56] References Cited

U.S. PATENT DOCUMENTS

| | | | |
|---|---|---|---|
| 2,009,167 | 7/1935 | Delano | 49/92 |
| 2,063,531 | 12/1936 | Tuttle | 250/33 |
| 2,944,926 | 7/1960 | Gaiser | 154/2.73 |
| 4,155,090 | 5/1979 | Kuroyanagi et al. | 343/713 |
| 4,260,989 | 4/1981 | Ishii et al. | 343/704 |
| 4,370,658 | 1/1983 | Hill | 343/713 |
| 4,439,771 | 3/1984 | Kume et al. | 343/704 |
| 4,491,844 | 1/1985 | Tsuchie et al. | 343/713 |
| 4,768,037 | 8/1988 | Inaba et al. | 343/713 |
| 5,005,020 | 4/1991 | Ogawa et al. | 343/713 |
| 5,363,114 | 11/1994 | Shoemaker | 343/713 |

FOREIGN PATENT DOCUMENTS

| | | |
|---|---|---|
| 61-15403 | 1/1986 | Japan . |
| 244101 | 10/1986 | Japan . |
| 62-43905 | 2/1987 | Japan . |
| 2200498 | 8/1988 | United Kingdom . |

*Primary Examiner*—Hoanganh Le
*Attorney, Agent, or Firm*—Gifford, Krass, Groh, Sprinkle, Anderson & Citkowski, P.C.

[57] ABSTRACT

An antenna which is particularly suited for use as an antenna for a radio, such as a cellular telephone, in a motor vehicle. The antenna includes a sheet of a flexible material, such as mylar, having a metal oxide coating on one side. The conductive strip is then connected to the radio whereupon the antenna operates as both a receiving and transmitting antenna.

4 Claims, 1 Drawing Sheet

ANTENNA FOR A CELLULAR PHONE

BACKGROUND OF THE INVENTION

I. Field of the Invention

The present invention relates generally to an antenna and, more particularly, to an antenna for a cellular phone, AM-FM radio, UHF-VHF television and CB radio.

II. Description of the Prior Art

There are a number of previously known antennas which are suited for use as a receiving and transmission antenna for a cellular phone in a motor vehicle. One type of such previously known antenna consist of an aerial which is mounted outside of the motor vehicle. The antenna is then electrically connected to the cellular phone by coaxial cable or the like.

One disadvantage of the previously known antennas of this type is that such antennas are relatively expensive to manufacture and frequently require the drilling of holes through the body of the motor vehicle in order to connect the cable and antenna together. These previously known antennas are also disadvantageous in that they create aerodynamic drag on the motor vehicle as the motor vehicle travels.

A still further type of antenna which is particularly suited for use with a cellular phone in a motor vehicle comprises a strip of flexible material having one or more conductive strips mounted to the flexible sheet. These strips form the antenna element and are connected to the cellular phone in any conventional fashion. The previously known antennas of this type, however, have a rather limited transmission and reception range.

SUMMARY OF THE PRESENT INVENTION

The present invention provides an antenna particularly suited for use an antenna for a cellular telephone in a motor vehicle which overcomes all of the above mentioned disadvantages of the previously known antennas.

In brief, the antenna of the present invention comprises a sheet of electrical insulating and preferably transparent material, such as Mylar. A metal oxide coating is then placed on one side of the sheet. Preferably, the metal oxide is a metallized oxide and the thickness of the coating sufficiently small so that the Mylar sheet, together with the oxide coating, remains transparent.

An electrically conductive strip is then secured along at least one edge of the sheet so that the conductive strip is in contact with the metal oxide coating. Preferably, the conductive strip is generally U-shaped and, consequently, extends along three sides of the Mylar sheet.

The coating and metal oxide, together with the conductive strip, form the antenna for the cellular phone. The cellular phone is electrically connected to the antenna by connecting a conventional cable between the conductive strip and the appropriate connectors on the cellular phone.

In practice, the antenna of the present invention has proven highly effective and efficient for cellular phone transmission and reception in a motor vehicle, such as a car. Furthermore, it has been found that the antenna can be mounted in the roof of the motor vehicle so that the strip is open to the interior of the vehicle and still retain good reception and transmission for the cellular phone.

BRIEF DESCRIPTION OF THE DRAWING

A better understanding of the present invention will be had upon reference to the following detailed description, when read in conjunction with the accompanying drawing, wherein like reference characters refer to like parts throughout the several views, and in which.

DETAILED DESCRIPTION OF A PREFERRED EMBODIMENT OF THE PRESENT INVENTION

Figure 1:
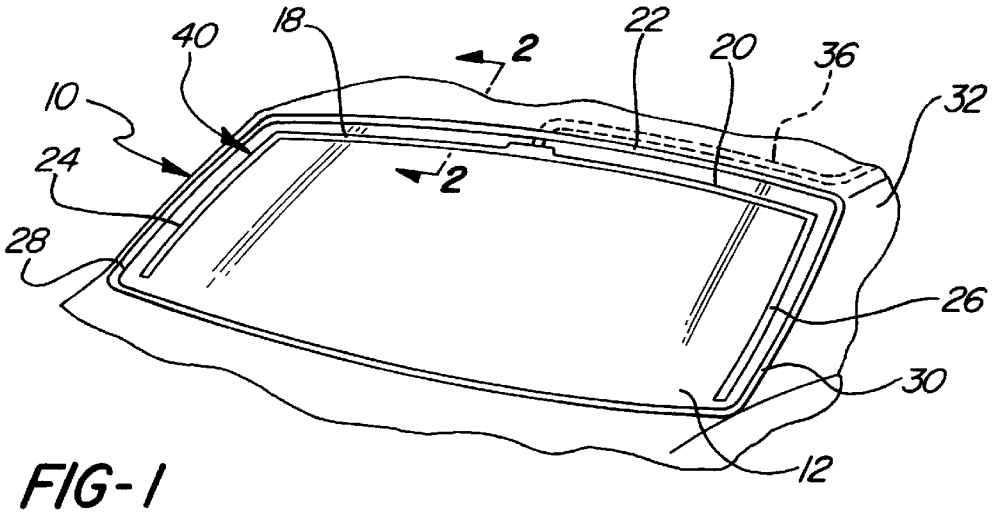
FIG. 1 is a fragmentary perspective view illustrating a preferred embodiment of the present invention.
Figure 2:
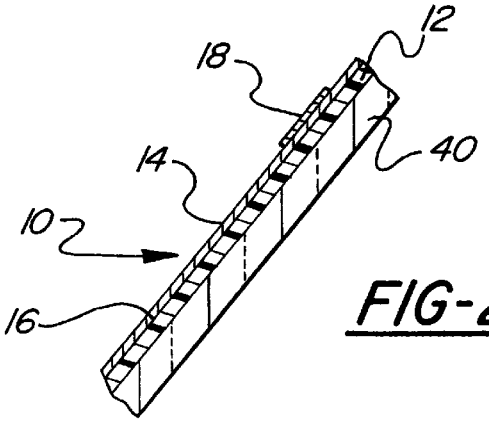
FIG. 2 is a fragmentary cross-sectional view taken substantially along line 2—2 in FIG. 1.

With reference first to FIGS. 1 and 2, a preferred embodiment of the antenna 10 of the present invention is thereshown and comprises a generally rectangular sheet 12 constructed of an electrical insulating material. Preferably the sheet 12 is constructed of Mylar which is flexible and transparent although other materials can be used without deviation from the spirit or scope of the present invention.

As best shown in FIG. 2 of the drawing, a coating 14 of metallic oxide covers one side 16 of the sheet 12. The metal oxide coating 14 is preferably tin oxide and is sufficiently thin so that it does not markedly impair the transparency of the sheet 12. Furthermore, in practice, the metal oxide coating 14 has a resistance of approximately seventy ohms per square centimeter.

Still referring to FIGS. 1 and 2, an elongated strip 18 of an electrically conductive material, such as silver, is attached to the antenna 10 so that the strip 18 contacts the metal oxide coating 14. As best shown in FIG. 1, the strip 18 includes a first segment 20 which extends along and adjacent the top edge 22 of the sheet 12. The conductive strip 18 also preferably includes two side segments 24 and 26 which extend along and adjacent opposed sides 28 and 30, respectively, of the sheet 12. Consequently, the strip 18 is generally U-shaped as best shown in FIG. 1 of the patent drawing.

Figure 3:
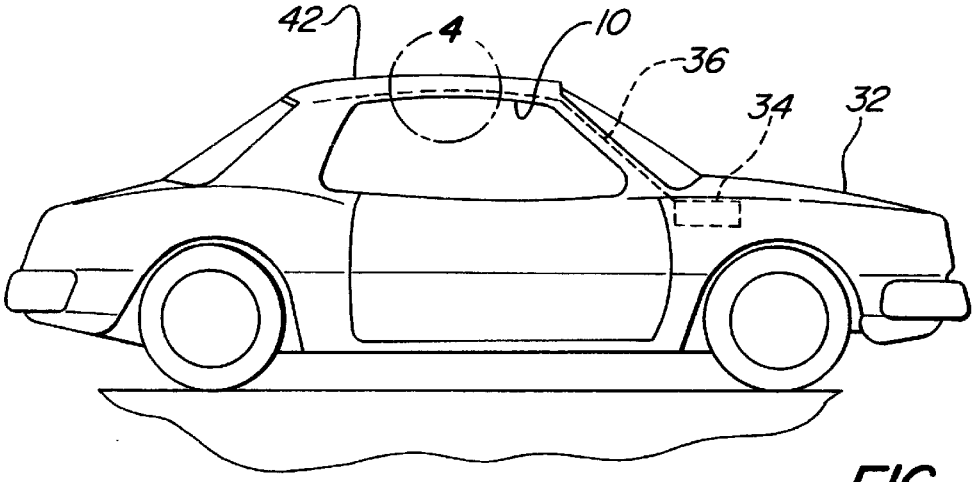
FIG. 3 is a side schematic view of the present invention but illustrating a modification thereof.

With reference now to FIGS. 1 and 3, the antenna 10 is preferably for use as an antenna for a cellular telephone in a motor vehicle 32, such as a car. The cellular telephone 34 is mounted in the car 32 in any conventional fashion and has its antenna input and output electrically connected by a cable 36 to the electrically conductive strip 18. With the cellular telephone 34 connected to the antenna 10 in this fashion, the antenna 10 acts as an antenna for both transmission and reception of radio signals and, more particularly, of radio signals in the cellular telephone band width. The cellular telephone band width is approximately 830 MHz–910 MHz.

Figure 4:
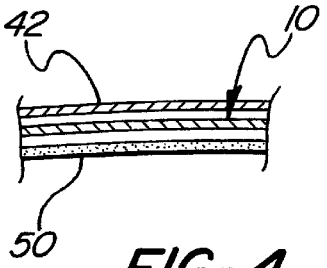
FIG. 4 is an exploded, enlarged view of circle 4 in FIG. 3.

In practice, the actual position of mounting the antenna 10 to the motor vehicle 32 has been found not to be critical. For example, as best shown in FIG. 1, the antenna 10 can be mounted on the glass 40 for the rear windshield of the motor vehicle 32. Since the Mylar sheet 12 is transparent and the metal oxide coating 14 sufficiently thin so that it does not materially affect the transparency of the Mylar 12, the driver of the vehicle can view through the rear windshield in the conventional fashion. Alternatively, as best shown in FIGS. 3 and 4 of the patent drawing, the antenna 10 can be mounted in the ceiling of the motor vehicle 32. Indeed, in practice, the antenna 10 can be connected to a metallic root 42 (FIG. 4) of a motor vehicle 32 on the interior side of the roof 42 so that the antenna is sandwiched in between the metal root 42 and a fabric interior layer 50 and still exhibit good transmission and reception characteristics.

The primary advantage of the antenna of the present invention is that the antenna can be inexpensively constructed and mounted to a plurality of different locations of the motor vehicle 32. A still further advantage of the present invention is that the antenna exhibits both excellent reception and transmission characteristics.

Having described by invention, however, many modifications thereto will become apparent to those skilled in the art to which it pertains without deviation from the spirit of the invention as defined by the scope of the appended claims.

I claim:

1. An antenna for a radio comprising:

a flexible plastic sheet, a metallic oxide coating on said sheet, an elongated strip extending along at least one side of said sheet, said strip being in contact with said metal oxide coating and having a high electrical conductivity, and means for connecting said strip to the radio wherein the radio is a cellular telephone wherein said antenna is mounted to and interior side of a roof of the motor vehicle.

2. The invention as defined in claim 1 wherein said oxide is metallized oxide.

3. The invention as defined in claim 1 wherein said strip is a silver strip.

4. The invention as defined in claim 1 wherein said sheet is substantially rectangular and wherein said strip is generally U-shaped, having three legs each of which extends along one edge of said sheet.

* * * * *